US006892858B1

(12) United States Patent
Zupan

(10) Patent No.: US 6,892,858 B1
(45) Date of Patent: May 17, 2005

(54) LADDER BAG AND METHOD OF USE

(76) Inventor: Kim Allyson Zupan, 3531 Honeysuckle Dr., Sarasota, FL (US) 34239

( * ) Notice: Subject to any disclaimer, the term of this patent is extended or adjusted under 35 U.S.C. 154(b) by 44 days.

(21) Appl. No.: 10/410,410

(22) Filed: Apr. 9, 2003

(51) Int. Cl.[7] ..... B65D 33/14
(52) U.S. Cl. ..... 182/129; 248/210; 206/373
(58) Field of Search ..... 182/129; 248/210; 206/373; 224/407, 430

(56) References Cited

U.S. PATENT DOCUMENTS 3,903,944 A * 9/1975 Montgomery et al. ..... 224/430
D344,180 S * 2/1994 Garcia ..... D12/416
5,533,600 A * 7/1996 Van Himbeeck et al. . 190/18 R
6,085,902 A * 7/2000 Fang ..... 206/373
6,435,304 B1 8/2002 Stierle
6,443,260 B1 9/2002 Katz
6,634,531 B2 * 10/2003 Conte ..... 224/407

* cited by examiner

*Primary Examiner*—Alvin Chin-Shue
(74) *Attorney, Agent, or Firm*—Dorothy S. Morse

(57) ABSTRACT

A rugged braced bag for securing hand tools and other equipment to a ladder, scaffold, or mechanical lift within easy reach of a worker. The bag has wide flexible support band with a rigid distal clip configured for engagement with a slot in one of its upstanding walls. Alternatively, the bag can be secured by the support band and clip engaging a ladder top, or the band encircling a ladder rung or horizontally-extending bar with the clip inserted into the slot. The bag has a shoulder strap and release handle used for raising the bag and ready release of the clip from its engaged position. Optionally, the bag can have compartments, pockets, and/or a removable liner. Applications can include, but are not limited to, use by carpenters, painters, electricians, plumbers, homeowners, and anyone needing to use tools and equipment while on a ladder, scaffold, lift, or other raised support structure.

20 Claims, 3 Drawing Sheets

LADDER BAG AND METHOD OF USE

CROSS-REFERENCES TO RELATED APPLICATIONS

None.

BACKGROUND OF THE INVENTION

1. Field of the Invention

This invention relates to the field of bags and trays used to transport handheld tools and other equipment to an elevated work site, and thereafter safely support them from the top surface of an A-frame ladder, a ladder rung, scaffold, and the like, in a convenient location for easy user access. The present invention is quickly attached to and released from a support structure via use of a clip on the distal end of a support band being inserted into a horizontally-extending slot in one of its own vertical walls or alternatively with its clip engaging the downwardly extending lip or edge of a horizontally-extending surface, such as an A-frame ladder top. The weight of the bag and its contents tightens the flexible support band to which the clip is attached, so that the clip cannot become disengaged until it is deliberately released. When clip release is desired, an upward force applied to a release handle attached near the proximal end of the support band slackens the support band and allows gravity to draw the clip away from its stronghold position. The present invention has a large and substantially rectangular interior space that is typically wider than the ladder to which it is attached and sufficient in size to carry at least one gallon of paint in combination with one or more handheld power tools, and/or various other tools, supplies, and equipment commonly used by painters, carpenters, professional window cleaners, homeowners, and/or others to perform work in high places that cannot be reached unassisted. It is desired for the present invention bag to be large enough to contain all of the equipment and supplies needed by a worker to complete his or her assigned tasks at elevation, to minimize the amount of repeated mounting and dismounting from the ladder, lift, scaffold, or other worker support structure that would otherwise be needed to retrieve forgotten and/or additional equipment and supplies. The bag is reinforced with at least one rigid brace and typically contains a shoulder strap for hands-free transport, however, optionally it may also have exterior pockets, interior pockets, temporary compartment dividers, and a removable water-resistant liner.

2. Description of the Related Art

People who frequently use ladders, lifts, and scaffold to perform work at elevation often find that they need to mount and dismount them many times in a day to obtain additional equipment and tools needed to complete their assigned tasks. Having to do this is time consuming an inefficient. Also, repeated climbing up and down ladders and scaffold tires a worker and over time can adversely affect some workers' leg muscles and knees. Most bags and trays currently used to support tools and equipment at elevation are too small to prevent frequent dismounts, not easily or rapidly secured and released at elevation, not adapted for secure transport and storage of power tools, not adapted to multiple types of elevation support, and/or not sufficiently rugged or durable for long-term use. In contrast, the present invention gives users sufficient storage space to consolidate in one place all of the hand tools, power tools, other equipment, and supplies needed to complete a designated work project at elevation, and then easily secure everything in a convenient, fixed, and out-of-the-way position if needed, while the work progresses. Quick attachment and release of the present invention from its secured position is also one of its advantages. Its flexible support band and clip make it adaptable to ladder steps, ladder rungs, and horizontally-extending bars, as well as to the top of a step ladder and other larger A-frame ladders. Further, the present invention has bracing that makes it rugged and maintains the bag's bottom surface in a substantially horizontally-extending position even when the interior space in the bag is not completely filled, allowing for more convenient access to the contents therein. In addition, its wide support band and clip allows it to be placed in a suspended position on the side of the ladder opposed to its user, or on the outside of a scaffold rail, as needed to place the present invention outside of the typically small and limited work area available at elevation. There is no device known for securing tools, supplies, and equipment to the top of a ladder, ladder rung, lift railing, or scaffold that has the same features and components as the present invention, nor all of its advantages.

Inventions performing functions similar to that of the present invention are disclosed in U.S. Pat. No. 6,443,260 to Katz (2002) and U.S. Pat. No. 6,435,304 to Stierle (2002). However, there are important structural and other differences between the Katz and Stierle inventions and the present invention, which distinguish the present invention therefrom, provide important advantages, and make it desirable to a user. The Katz invention discloses a tray that can be attached to the top of a step ladder using various clamping arrangements. However, it is not readily attachable to scaffold or to the rung of an extension ladder. In contrast, the present invention offers its users a faster and more simplified means of engagement and release from a ladder top and has equally fast means of engagement and release when used with extension ladders, scaffold, and lifts. Conversely, the Stierle invention discloses a tool bag configured for use with extension ladders and scaffolding, but which is not conveniently configured for connection to the top of a step ladder or taller A-frame ladder. The Stierle invention fits laterally between extension ladder rails and its smaller than the present invention, and would be unlikely to hold all of the tools and equipment needed by a professional carpenter, electrician, and/or painter at elevation. Also, the Stierle invention has side sleeves into which the top portion of the extension ladder rails can be inserted for rail support of its bag, in addition to a pair of hooks connected to the back of its soft fabric bag that is spaced to engage a ladder rung. The present invention is different from the Stierle invention in that it has a suspension/engagement means that can be quickly and conveniently secured to the top of a step ladder, and then promptly repositioned for support by the rung of an extension ladder, scaffold, or a lift, as well as other structures comprising horizontally extending railing or bars with a diameter dimension larger than that of a traditional extension ladder rung. The width dimension of the present invention bag is generally greater than the spaced-apart distance between the rails of the ladder to which it is attached, and since it has no side sleeves it can have outside pockets attached to its side surfaces to increase its storage capacity. Also, the present invention has a suspension/engagement means that does not limit its use to narrowly dimensioned rungs or rails. Thus, the present invention has important advantages over the Katz and Stierle inventions. There is no tool bag or other tool transport or carrying device presently known that has the same features and all of the advantages of the present invention.

BRIEF SUMMARY OF THE INVENTION—OBJECTIVES AND ADVANTAGES

The primary object of this invention is to provide a rugged means for conveniently transporting tools and equipment to an elevated work site, promptly placing them in a securely fixed and easily accessible position while work at the elevated site progresses, and then when no longer needed at that site allowing for quick release and relocation. A further object of this invention is to provide a rugged device for the safe transport and storage of equipment and tools to an elevated work site that is versatile and capable of connection to the top surface of a step ladder as well a ladder rung, scaffold, the railing used on a lift, and other structures able to support a person needing to reach high work sites. It is also an object of this invention to provide a rugged device that is capable of safely transporting and storing power tools to an elevated work site. A further object of this invention is to provide a device for the safe transport and storage of equipment and tools to an elevated work site that is constructed and made from durable materials for long-term use. It is a further object of this invention to provide a device for the safe transport and storage of equipment and tools to an elevated work site that helps the user organize the items therein for efficient access. A further object of this invention is to provide a device for the safe transport and storage of equipment and tools to an elevated work site that is capable of supporting equipment and tools in a substantially upright and conveniently reached position even when the device is not completely filled. It is also an object of this invention to provide a device for the safe transport and storage of equipment and tools to an elevated work site that is easy to use and maintain.

As described herein, properly manufactured and used, the present invention is a rugged tool and equipment bag that is configured and dimensioned for the safe and convenient transport of its contents to an elevated work site. The interior space defined by its four upstanding walls and bottom surface is sufficient for one or more one-gallon cans of paint, in combination with one or more handheld power tools, and all of the other supplies and equipment needed to accomplish a work project at elevation, including that needed by a homeowner to clean ceiling fans, elevated plant shelves, and other high surfaces. Its shoulder strap allows it to be conveniently carried hands-free to an elevated work site, whereafter the rugged support band and its distal clip provides secure connection across the top of a ladder, or to the rung of a ladder and/or any other conveniently located horizontally-extending railing, bar, or rung-like structure. Where work space is limited, the bag can be suspended against the outside surface of the scaffold, railing, bar, or rung-like structure strong enough to support it. The distal clip allows for prompt placement of the present invention bag into a fixed position easily accessible to its user, with the weight of the bag causing the wide support band to tighten and thereby hold the clip in place until it is deliberately released. When relocation of the bag is needed, the user simply exerts a quick upward force to the release handle sufficient to slacken the support band and allow gravity to draw the clip downward from its engaged position. Once the clip is disengaged, further upward movement of the release handle can draw the bag away from the object to which it was connected for relocation. Due to the size of the interior space provided by the bag, its rugged construction, and the bracing made a part of the upstanding wall in which its slot is located, the present invention can provide safe transport of equipment and tools to an elevated work site, as well as secure storage at elevation, even for handheld power tools. Bracing also provides substantially upright orientation for the contents held by the bag, whereby they can be easily reached, even when the bag is not completely filled. Although two braces are preferably used, it is contemplated for the bracing to be in the form of one or more horizontally extending bars secured within or attached to the outside or inside surface of the upstanding wall containing the present invention slot. Compartment dividers, as well as internal and/or external pockets, optionally add to the storage and transport capability of the present invention, as well as the efficiency and convenience of content retrieval. Maintenance of the present invention tool bag can be minimized by use of a detachable liner secured with quick-release fasteners and configured to protect interior bag surfaces from paint spills, caulk, and other compounds that can be easily transferred to the bag from tools and product containers stored therein. It is contemplated for the material used for constructing the bag, shoulder strap, support band, and release handle to be sturdy, easily washable, water-resistant, lightweight, and durable to minimize maintenance and provide long-term use. Preferably, the shoulder strap would be padded and adjustable, although neither is critical. Also, the slot makes the present invention more versatile by allowing it to be connected to many types of support structures, such as a ladder, rung, railing, bar, or other horizontally-extending rung-like structure without regard to its cross-sectional dimension, in addition to support by the top surface of a step ladder, taller A-frame ladder, or any horizontally-extending surface having a combined width and height dimension less than the length of the support band and a downwardly-extending lip or edge suitable for secure engagement with the present invention clip.

While the description herein provides preferred embodiments of the present ladder bag invention, it should not be used to limit its scope. For example, variations of the present invention, while not shown and described herein, can also be considered within the scope of the present invention, such as variations in the width and thickness dimensions of its support band; the type of rugged material from which its support band, bag, and shoulder strap are made; the configuration and dimension of its rigid clip; the amount of padding used in the shoulder strap, if any; the means used for shoulder strap adjustment, if any; the number and location of pockets and compartment dividers used to enhance storage capacity; the length of the release handle; and the length dimension and position of the slot used for clip engagement. Thus, the scope of the present invention should be determined by the appended claims and their legal equivalents, rather than being limited to the examples given.

DETAILED DESCRIPTION OF THE INVENTION

Figure 2:
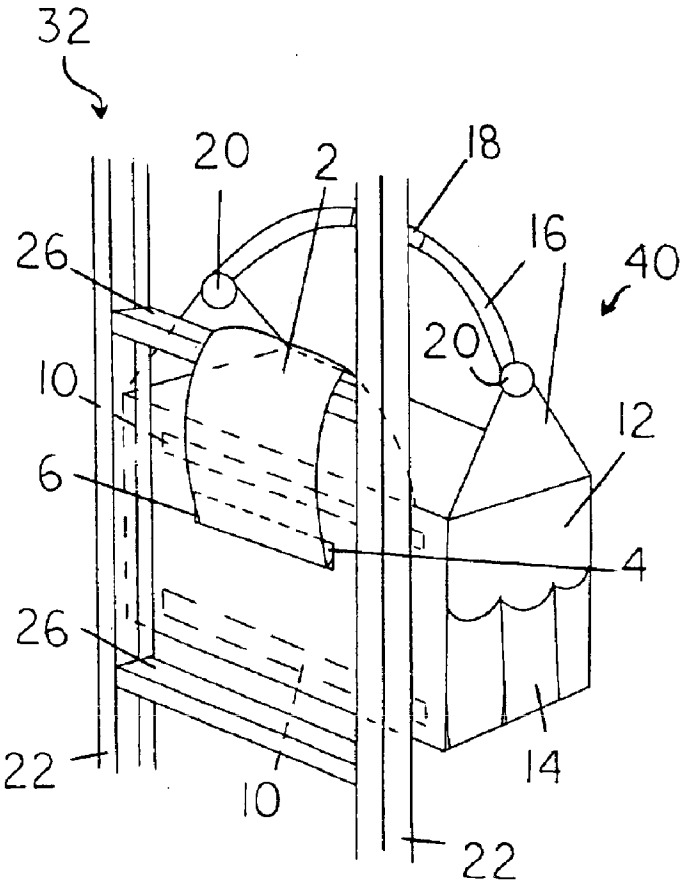
FIG. 2 is a perspective view of the most preferred embodiment of the present invention attached around one of the rungs of an extension ladder, with the clip on the distal end of the wide support band being fixed within the present invention slot.
Figure 1:
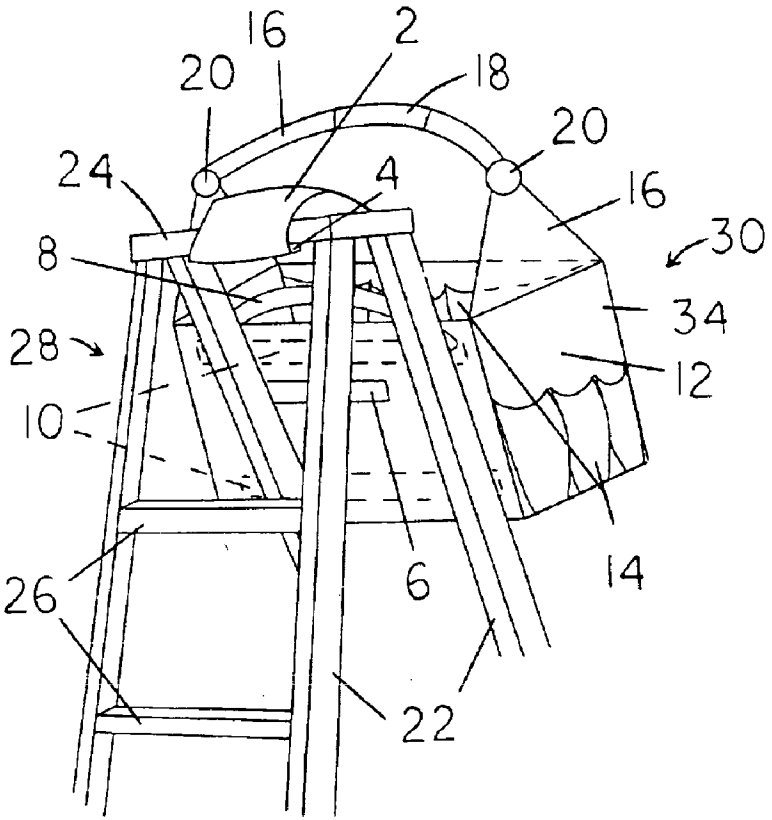
FIG. 1 is a perspective view of the most preferred embodiment of the present invention as it is being attached to the top of an A-frame ladder whereby when fully in place the weight of the bag and its contents will pull the support band taught and fix the clip on the distal end of the support band securely under the downwardly-extending lip of the ladder top until it is deliberately released via use of the release handle positioned adjacent to the proximal end of the support band.

FIGS. 1–5 show several closely related preferred embodiments 30, 40, and 42 of the present invention ladder bag capable of transporting a variety of handheld tools and other equipment (not shown) to an elevated work site and fixing them securely in a location of convenient access to a user (not shown). Multiple support configurations are illustrated for the present invention. For example, in FIG. 1, the present invention's generally U-shaped clip 4, located on the distal end of support band 2, is connected to a downwardly depending lip or edge on the user side of a step ladder's or A-frame ladder's top surface 28. Support band 2 is extended across ladder top 28, but not yet taut. When the force of gravity on bag 34 and any contents (not shown) pull support band 2 taut, clip 4 cannot thereafter be easily inadvertently disengaged from its ladder connection and the attached bag 34 becomes securely suspended in an out-of-the-way yet easily accessible position against the far surface of the ladder rails 22 remote from the user. In the alternative, as shown in FIG. 2, clip 4 can be extended around the step/rung 26 of an extension ladder 32 and inserted into slot 6 so that support band 2, clip 4, and the upper portion of the wall of bag 34 having slot 6, all in combination from a closed loop around step/rung 26. The size of step/rung 26 or other horizontally-extending bar around which support band 2 is extended is not critical and the cross-sectional dimension of the supporting structure for support band 2 can be several times larger that a typical ladder step/rung 26. Although not shown, the engagement of clip 4 within slot 6 can also be used for attachment of bag 34 to scaffold, a lift, a horizontally extending bar, or other support structure having a substantially horizontally-extending railing or rung-like configuration. As shown in FIGS. 1 and 2, bag 34 is typically wider than A-frame ladder 28 or extension ladder 32, with a substantially rectangular shape that is reinforced with braces 10 to permit upright positioning of the items placed therein. Although not limited thereto, it is preferred for braces 10 to be sufficiently long to engage side rails 22. The shoulder strap 18 of most preferred embodiment 30 would be adjustable and configured for use in carrying bag 34 hands-free. A padded configuration for shoulder strap 18 is also contemplated, but not critical. Pockets, such as but not limited to the inside and outside pockets 14 shown in FIG. 1, and detachable or permanent compartment dividers, such as the temporary compartment divider 36 shown in FIG. 8, can optionally be used to increase the storage capacity and/or organized placement of objects within bag 34 for prompt and efficient retrieval. The weight of bag 34 and its contents (not shown) extend support band 2 into a taut configuration, thereby preventing clip 4 from becoming inadvertently loosened from its engaged position. Release of clip 4 can be easily and readily accomplished by applying an upwardly directed force (not shown) to release handle 8, whereby support band 2 becomes slack and allows gravity to release clip 4 from its engaged position. Although it is contemplated for different embodiments of the present invention to have bag 34 varying in size, it is also contemplated for bag 34 to generally be sufficiently large to house all of the hand tools, power tools, equipment, and supplies required for a carpenter, painter, electricians, plumber, homeowner, or other in performing routine work in their respective fields.

FIG. 1 shows the most preferred embodiment 30 of the present invention attached to the top of an A-frame ladder 28, so that its bag 34 is positioned against the outside surface of the ladder rails 22 remote from a user (not shown). The support band 2 of the present invention extends over ladder top 24 for engagement of clip 4 under the edge of ladder top 24 on the user's side of ladder 28. Bag 34 is shown to extend laterally beyond ladder rails 22, with the side of bag 34 facing ladder rails 22 having two horizontally-extending braces 10, one central slot 6, and a release handle 8 positioned above slot 6. Braces 10 are shown to engage vertically extending ladder rails 22. Although one slot 6 is shown, with a generally U-shaped clip 4 configured to engage it, it is also considered to be within the scope of the present invention to have more than one slot 6 and clip 4 with a double or triple U-shaped configuration or otherwise adapted for secure engagement with the multiple slots 6, as positioned. FIG. 1 also shows preferred embodiment 30 having a shoulder strap 16 with a means 18 for adjusting its length and two connectors 20 allowing for removal of the central portion of shoulder strap 16 therebetween, as well as multiple pockets 14 attached to the outside surface on one end of bag 34 as well as to the interior surface on one side of bag 34. Instead of shoulder strap 16 having an adjustable configuration, a longer or shorter shoulder strap 16 could be substituted between connectors 20, as needed. Connectors 20 would also allow for exchange of a new shoulder strap 16 for one that exhibits signs of wear, or a padded shoulder strap 16 for one that lacks padding. In the alternative, the support band 2 of preferred embodiment 30 could be extended around a step/rung 26 between ladder rails 22, as shown in FIG. 2, with clip 4 inserted into slot 6.

FIG. 2 shows a second preferred embodiment 40 of the present invention attached around one of the rungs 26 of an extension ladder 32. Pockets 14 are attached to the outside surface on one end of bag 34, however no pockets 14 are shown attached to the interior surface of bag 34, although pockets 14 could be hidden from view on the inside surface of the upstanding wall of bag 34 having braces 10 and slot 6. In FIG. 2, support band 2 is shown to extend around one step/rung 26 with the generally U-shaped clip 4 on the distal end of support band 2 being inserted into slot 6 so that support band 2, clip 4, and the upper portion of bag 34, all in combination form a closed loop around step/rung 26. The width of slot 6 is not limited to that shown, and can be wider and thicker than that illustrated, although weight considerations dictate that support band 2 not be wider or thicker than needed to successfully perform is support function for bag 34 and the objects routinely intended for placement therein. Further, bag 34 is shown to have a large width dimension that extends laterally beyond ladder rails 22, and is not limited to positioning between rails 22. FIG. 2 also shows preferred embodiment 30 having a shoulder strap 16 with a means 18 for adjusting its length and two connectors 20 allowing for temporary removal of the central portion of shoulder strap 16 therebetween, as desired. When the central portion of shoulder strap 16 is removed, it is contemplated that the triangular end portions of shoulder strap 16 could each be made to fold down over the inside or outside surface of the end wall of bag 34 closest thereto.

Figure 4:
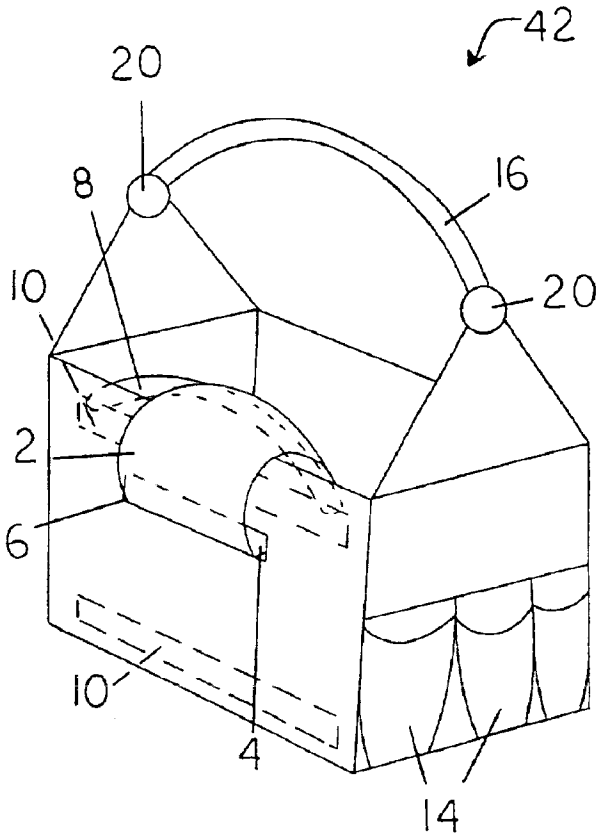
FIG. 4 is a perspective view of the most preferred embodiment of the present invention having a shoulder strap, a release handle secured to the inside of its bag adjacent to the proximal end of the support band, and with the rigid distal clip on its flexible support band being inserted into its slot so that the support band and a portion of the upstanding wall to which it is attached form a closed loop.
Figure 3:
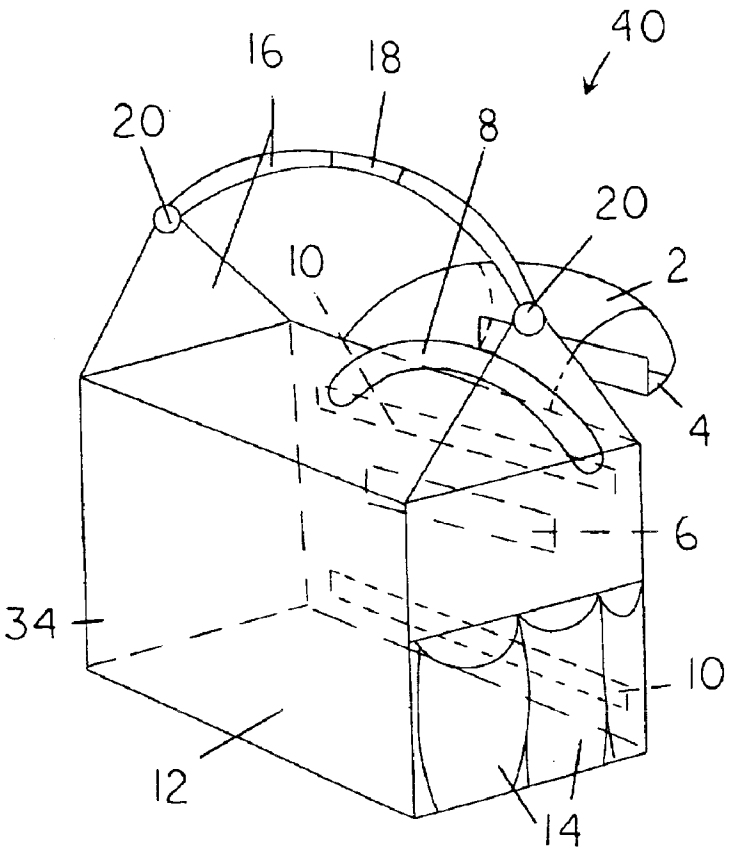
FIG. 3 is a perspective view of the most preferred embodiment of the present invention having a hollow interior space, an adjustable shoulder strap, a release handle, a flexible support band with a rigid clip on its distal end, a slot through the same upstanding wall to which the support band is attached, two spaced-apart braces within the upstanding wall having the slot, and three outside pockets on one end.

FIGS. 3 and 4 respectively show second preferred embodiment 40 and a third preferred embodiment 42 of the present invention independent from any support structure. One upstanding wall of bag 34 has a slot 6 formed centrally therethrough, one horizontally-extending brace 10 positioned above slot 6, a second horizontally-extending brace 10 positioned below slot 6, the proximal end of support band 2 attached to its upper surface and upwardly depending therefrom above the second horizontally-extending brace 10, a generally L-shaped or U-shaped clip 4 depending from the distal end of support band 2, and release handle 8 attached near the proximal end of support strap 2. Whether clip 4 is L-shaped or U-shaped, or has another similar configuration that allows it to be secured within slot 6, would depend upon the manner of connection to support band 2, which is not critical and contemplated to include any means by which rigid clip 4 can become securely attached to the flexible support band 2, such as but not limited to adhesives, bonding agents, fasteners, and/or a combination thereof. In addition, FIG. 3 shows three outside pockets 14 on one end of bag 34, while FIG. 4 shows three outside pockets 14 on the opposed end of bag 34. In FIGS. 1–4, pockets 14 can be formed on any number of the upstanding walls of bag 34, as well as on the inside and outside surfaces thereof. It is also contemplated for inside pockets 14 to be permanently fixed into position, or temporarily attached for removal or repositioning, as needed. Pockets 14 may vary in size and width, and also be taller or shorter than shown. Although FIGS. 3 and 4 both show shoulder strap 16 being secured between connectors 20 only FIG. 3 shows the central portion of shoulder strap 16 having a means 18 of length adjustment. Also, although not independently shown, shoulder strap 16 may be padded for user comfort.

Figure 5:
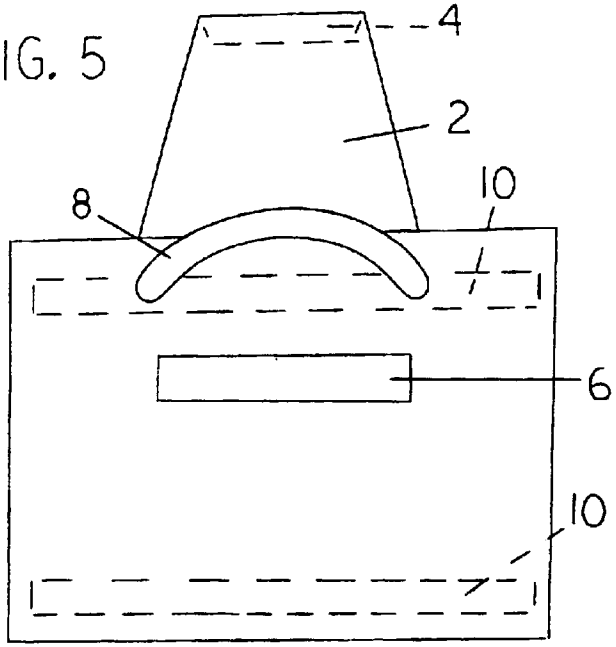
FIG. 5 is a rear view of one of the upstanding walls in the most preferred embodiment of the present invention bag having a flexible support band upwardly depending from its top surface, a rigid clip on the distal end of the support band, a horizontally-extending release handle positioned adjacent to the proximal end of the support band, two spaced-apart horizontally-extending braces, and a horizontally-extending slot therethrough below the release handle.

FIG. 5 shows one of the upstanding walls of bag 34 in the most preferred embodiment 30 of the present invention bag having a generally U-shaped clip 4 hidden behind support band 2 and attached to the distal end of support band 2. Although not shown, rivets or other fastening means, including adhesive bonding agents, can be used to secure clip 4 to the distal end of support band 2. FIG. 5 also shows the proximal end of support band 2 upwardly depending from the top edge of the upstanding wall of bag 34, release handle 8 positioned near the proximal end of support band 2, two horizontally-extending braces 10 secured within the upstanding wall of bag 34 or attached to its outside surface, and slot 6 in a position between braces 10. The widths of support band 2, clip 4, release handle 8, and slot 6 can vary and within a single embodiment be the same or greater than that shown in FIG. 5. Typically however, the width of slot 6 would be substantially similar to the width of clip 4, and the width of release handle 8 would be close in dimension to that of support band 2.

Figure 6:
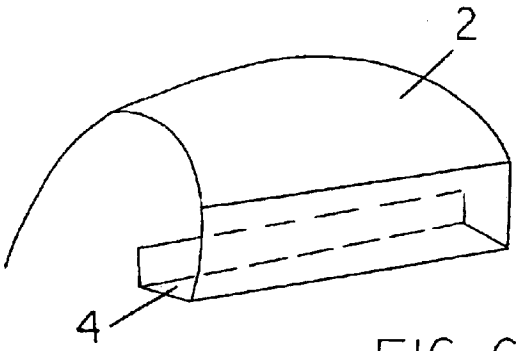
FIG. 6 is a perspective view of the flexible support band in the most preferred embodiment present invention with the rigid clip on its distal end.

FIG. 6 shows support band 2 in the most preferred embodiment present invention being made of flexible material so that the rigid clip 4 on its distal end can be extended around a ladder step/rung 26 and inserted into slot 6. Support band 2 may be made from the same material as bag 34, or other material. However, the material for support band 2 should be easily washable, as well as strong but light in weight. In addition, it may be water-resistant and woven or not woven. The length of support band 2 is proportional to the intended application of bag 34 and the maximum weight it would be expected to carry, however, it is contemplated for support band 2 to be wide and substantially extend across the width of bag 34. Although not shown, clip 4 may be attached to the distal end of support band 2 with a combination of stitching, bonding, rivets, and/or other secure fastening means that allow it to remain connected to the distal end when subjected to the full weight of bag 34 and its contents. Its shape would depend upon the connection means used to secure it to support band 2. However, it is preferred for clip 4 to be generally L-shaped or U-shaped. It is also contemplated for the proximal end of support band 2 to be attached to the upstanding wall of bag 34 by any means allowing it to remain connected to bag 34 when subjected to the weight of its contents, such as but not limited to, stitching; a combination of stitching and other means; a plurality of fasteners, stitching, and/or bonding means; or by having support band 2 and the upstanding wall of bag 34 to which it is connected being formed from a single piece of material alone or in combination with reinforcement stitching and/or reinforcing fasteners. Although FIG. 6 shows support band 2 only as comprising a single layer of material, in the alternative it is also contemplated for support band 2 to comprise multiple layers of material where required to enhance its strength, and for any one of such reinforcing layers to extend the full width of support band 2 or a part thereof.

Figure 7:
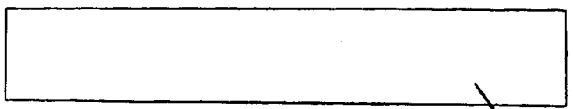
FIG. 7 is a front view one of the reinforcing bars of used in the most preferred embodiment present invention to strengthen the upstanding wall to which the support band is connected.

FIG. 7 shows one embodiment of reinforcing bar used as a brace 10 in association with the one of the upstanding walls of bag 34 having slot 6. Braces 10 are preferably flat, although not limited thereto, and they also can have other end configurations in place of the angular shape shown in FIG. 7, such as but not limited to round and camphered end configurations. It is contemplated for braces 10 to be rigid and made from strong material, such as metal. Where the intended application of the present invention indicates a need for braces 10 to be made from corrosion resistance material for durability and long-term use of bag 34, braces 10 can be made from stainless steel or protected by corrosion resistant coverings, such as plastic or paint. Availability of materials, as well as a cost/benefit determination, would be factors in selecting the materials used to make braces 10, as well as their length, width, and thickness dimensions. Braces 10 preferably extend substantially across the entire width of the upstanding wall of bag 34 into which they are incorporated. Also, braces 10 can be installed within, against the outside surface of, or against the inside surface of the upstanding wall of bag 34. At least one brace 10 is contemplated, which can have a greater width dimension than is shown in FIGS. 1–5, and 7. When one brace 10 is used, it is contemplated that the single brace 10 would be positioned in the upper half of bag 34. Depending upon the intended use, the present invention may have a greater number of braces 10 than is shown in FIGS. 1–5, and 7 with each brace 10 having the same or smaller width dimension. If several braces 10 are used within a single embodiment of bag 34, each may have the same or a different width dimension, although it is contemplated that all braces 10 within the same embodiment would preferably have substantially the same thickness dimension. The number of braces 10 used would be determined by the cost thereof as compared to the benefit provided for the intended application.

Figure 8:
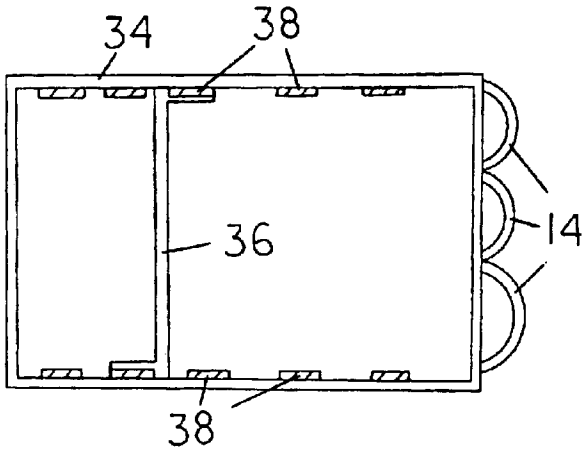
FIG. 8 is a top view of the present invention bag showing one side having outside pockets and a detachable compartment divider attached to the interior bag walls with quick-release fasteners.

FIG. 8 shows one side of the present invention bag 34 having three outside pockets 14 of varying size and a detachable compartment divider 36 attached to the interior walls of bag 34 with quick-release fasteners 38. Additional unused fasteners 38 are shown in FIG. 8 for relocation of compartment divider 36 as needed, or the connection of one or more additional compartment dividers 36 (not shown). Although it is preferred that compartment dividers 36 be flexible, they can also be rigid. Also, the thickness of compartment dividers 36 can be greater or less that is shown in FIG. 8. Further, although not shown, fasteners 38 or other means can be used to temporarily attach a liner to protect the interior surfaces of bag 34 from spills of paint, caulk, and undesirable materials easily transferred from equipment to hands and clothing. The liner can fully be inserted within the interior space of bag 34, or have upper edges that extend over one or more of the upstanding walls of bag 34 for ease in removing it after use. Although use of a means of attachment between such a liner and bag 34 is not critical, nor is the type selected, some simple form of quick-release attachment between a liner and bag 34 is preferred for optimum protection of the interior surfaces of bag 34. Also, the liner can be disposable or reusable at least several time, until spills or tears therein require its replacement.

I claim:

1. A device for transporting handheld tools and other equipment to an elevated work site, and thereafter safely supporting them from the top surface of an A-frame ladder, a ladder rung, scaffold, a lift, and similar worker supports, in a convenient location for easy worker access, said device comprising:

a sturdy bag having four upstanding walls and a bottom surface that together define a large and substantially rectangular interior space, with one of said walls having a top portion, an interior surface, and at least one centrally positioned horizontally-extending slot with a width dimension adapted to fit between a conventional A-frame ladder rails;

at least two horizontally-extending rigid braces incorporated as a part of the same one of said upstanding walls containing said at least one slot and extending substantially across said upstanding wall, with a first one of said braces being positioned above said at least one slot and a second one of said braces being positioned below said at least one slot;

a support band having a tapering configuration with a distal end that is smaller than its opposed proximal end, with said proximal end depending connected to and centrally from said top portion of the one of said upstanding walls having said at least one slot, said distal end having a width dimension that is slightly smaller than said width dimension of said at least one slot;

rigid engagement means attached to said distal end of said support band, with the width dimension of said rigid engagement means being smaller than said width dimension of said at least one slot, said rigid engagement means secured within said at least one slot in a supporting engaged position;

shoulder strap means attached to two of the upstanding walls that are opposed to one another and connected to said wall having said at least one slot; and a handle connected to said interior surface of the one of said upstanding walls having said at least one slot in a position near to said proximal end of said support band so that when said support band is stretched taut over a supporting structure and secured by said rigid engagement means in said supporting engaged position so as to suspend said bag in a location for easy worker access, the worker need only apply an upward lifting force to release said handle means to slacken said support band and allow said rigid engagement means on said distal end of said support band to be released via gravity from its engaged position, whereby said bag is thereafter promptly made available for transport by said shoulder strap to a new location.

2. The device of claim 1 wherein said at least one slot comprises one elongated and substantially horizontally extending slot.

3. The device of claim 1 wherein said shoulder strap is adjustable.

4. The device of claim 1 wherein said braces are selected from a group consisting of elongated braces, narrow braces, wide braces, flattened braces, braces made from strong materials, and braces comprising metal.

5. The device of claim 1 wherein said rigid engagement means comprises one elongated clip, and further wherein said clip is selected from a group consisting of generally U-shaped clips and generally L-shaped clips.

6. The device of claim 5 wherein said clip and said at least one slot have substantially similar width dimensions.

7. The device of claim 1 wherein said bag further comprises at least one pocket.

8. The device of claim 1 wherein said bag further comprises at least one compartment divider.

9. The device of claim 1 wherein the one of said upstanding walls containing said at least one slot also has an exterior surface, and wherein said braces are selected from a group consisting of braces secured to said interior surface, braces secured to said exterior surface, and braces positioned adjacent to said interior surface.

10. The device of claim 1 wherein said shoulder strap further comprises padding adapted and configured for user comfort in lifting said bag.

11. The device of claim 1 wherein said shoulder strap has at least one central portion, and said at least one central portion of said shoulder strap is removable.

12. The device of claim 1 further comprising a fluid-resistant liner.

13. A device for transporting handheld tools and other equipment to an elevated work site, and thereafter safely supporting them from the top surface of an A-frame ladder, a ladder rung, scaffold, a lift, and similar worker supports, in a convenient location for easy worker access, said device comprising:

a sturdy bag made from rugged material and having four upstanding walls and a bottom surface that together define a large and substantially rectangular interior space, with one of said walls having a top portion, an interior surface, and one centrally positioned horizontally-extending slot with a width dimension adapted to fit between a conventional ladder rails;

two rigid braces incorporated as a part of the one of said upstanding walls containing said slot, said braces extending horizontally substantially across said upstanding wall, with one of said braces being positioned above said slot and the other one of said braces being positioned below said slot;

a support band having a distal end and a proximal end, with said proximal end connected to and depending centrally from said top portion of the one of said upstanding walls having said slot, said distal end having a width dimension that is slightly smaller than that of said slot;

a clip attached to said distal end of said support band, said clip having a width dimension that is slightly smaller than that of said slot, said clip secured within said slot in a supporting engaged position;

a shoulder strap connected to two of the upstanding walls that are opposed to one another and connected to said wall having said slot; and a handle connected to the interior surface of the one of said upstanding walls having said slot near to said proximal end of said support band so that when said support band is pulled taut over a supporting structure and secured by said clip in said supporting engaged position so as to suspend said bag in a location for easy worker access, the worker need only apply an upwardly lifting force to release handle to slacken said support band and allow said clip on said distal end of said support band to be released via gravity from its engaged position, whereby said bag is thereafter promptly made available for transport by said shoulder strap to a new location.

14. The device of claim 13 wherein said shoulder strap is adjustable.

15. The device of claim 13 wherein said braces are selected from a group consisting of elongated braces, narrow braces, wide braces, flattened braces, braces made from strong materials, and braces comprising metal.

16. The device of claim 13 wherein said bag further comprises at least one pocket.

17. The device of claim 13 wherein said bag further comprises at least one compartment divider.

18. The device of claim 13 wherein the one of said upstanding walls containing said slot also has an exterior surface, and wherein said braces are selected from a group consisting of braces secured to said interior surface, braces secured to said exterior surface, and braces positioned adjacent to said interior surface.

19. The device of claim 13 wherein said shoulder strap has at least one central portion, and said at least one central portion of said shoulder strap is removable.

20. The device of claim 13 further comprising a fluid-resistant liner.

* * * * *